US006443798B1

(12) United States Patent
Perry

(10) Patent No.: US 6,443,798 B1
(45) Date of Patent: Sep. 3, 2002

(54) BUILDING BLOCK TOY SET

(76) Inventor: Mike Perry, 200 Oneil Blvd., Attleboro, MA (US) 02703

( * ) Notice: Subject to any disclaimer, the term of this patent is extended or adjusted under 35 U.S.C. 154(b) by 0 days.

(21) Appl. No.: 09/550,270

(22) Filed: Apr. 13, 2000

(51) Int. Cl.[7] ..... A63H 33/08

(52) U.S. Cl. ..... 446/127; 446/112; 446/114; 446/124

(58) Field of Search ..... 446/127, 114, 446/115, 116, 120, 121, 108–113, 124, 128, 122, 112; 434/168; 238/10 A, 10 B; 52/605, 609, 580.21, 585.1, 591.4, 591.5; 273/157 A, 157 R

(56) References Cited

U.S. PATENT DOCUMENTS 1,150,363 A * 8/1915 Haskins ..... 446/112
1,281,856 A * 10/1918 Shaw ..... 446/112
1,355,580 A * 10/1920 Tyson ..... 52/609
3,362,739 A * 1/1968 Staeger et al. ..... 52/285.1
3,603,026 A * 9/1971 Kishigami ..... 446/122
3,827,177 A * 8/1974 Wengel ..... 446/116
3,913,289 A * 10/1975 Recker ..... 446/114
5,212,842 A * 5/1993 Glydon ..... 446/85
5,600,910 A * 2/1997 Blackburn ..... 273/157 R
6,250,029 B1 * 6/2001 Jeffers et al. ..... 52/585.1

* cited by examiner

*Primary Examiner*—Derris H. Banks
*Assistant Examiner*—Urszula M Cegielnik

(57) ABSTRACT

A building block toy set having flat plate elements containing semi-circular recesses located along the periphery thereof. The flat plate elements are interconnected utilizing various configurations of interconnection elements that are received within the recesses. The flat plate elements may have various geometric shapes such as triangles, squares and rectangles. The multi-configured interconnection elements allow for numerous plate element interactions, which enable the creation of a large variety of structures.

12 Claims, 6 Drawing Sheets

BUILDING BLOCK TOY SET

BACKGROUND OF THE INVENTION

The majority of building toys fall into three categories of full-scale construction: masonary, wood, and steel. The success of Lego as the masonry, Lincoln-Logs as the wood, and Erector-Set as the steel system has influenced similar designs over the years. The above mentioned products and those that fall into similar categories lack a piece that can effectively define a volume of space. Several products and building block inventions have planer pieces that are comprised of interlocking slabs. Typically, the toys have square pieces that are notched so that they can be joined with other identical pieces to form a hollow cube. The following three inventions all have this characteristic: Toy Construction Block U.S. Pat. No. 1,894,061, Toy Construction Element U.S. Pat. No. 2,558,591, and Cuboidal Structure U.S. Pat. No. 3,924,376. The three above-mentioned inventions can effectively form cubes, but in each case, the edge of the finished cube has a smooth interlocking fit that will not allow an additional piece to join on any side. The above mentioned inventions have pieces that can be joined two dimensionally indefinitely to make long square tubes or they can be joined at right angles to form indefinite zig-zag stairs. The invention described herein comprises interconnecting plate elements that allow four way connections giving this invention the optimal construction flexibility for building three dimensionally. This invention enables a toy enthusiast to create simple volumes like cubes that can be embellished on increasingly more sophisticated levels. Furthermore, multi-configured circular/semi-circular disk elements used to interconnect plate elements reduce the complexity of the invention described herein while still enabling the creation of a large variety of structures.

The invention described in U.S. Pat. No. 4,253,268 to Mayr describes a playtoy building block set having flat plate elements which interlock with pressure inserted ball joint sockets. These pressure engagement type ball and socket interconnecting elements are expensive to manufacture and require the use of semi-elastic plastic plate elements for proper interlocking. The interconnecting elements of the present invention are less complicated to manufacture and can be constructed from a variety of different materials.

SUMMARY OF THE INVENTION

This invention relates to a building block toy set made up of flat plates that are dimensioned in a variety of geometric configurations. The plates are flat geometric figures such as squares, triangles and rectangles that are adapted to be joined to each other to form three-dimensional figures. The plates have symmetrically arranged cavities on their edges that are adapted to receive disk like interconnecting elements. These interconnecting elements allow corresponding edges of the plate elements to be united to form three-dimensional figures. The interconnection elements come in a variety of configurations to allow for the creation of a multitude of three-dimensional figures. The plates and interconnecting elements can be made from a variety of materials. The interior of the plate elements can have various cutouts, to represent windows, doors, etc. in a toy building structure.

It is an object of the present invention to provide a building block toy set wherein the basic units are simple, flat, geometrical figures such as squares, rectangles and triangles that are adapted to be joined to each other by disk like interconnecting elements to form three dimensional structures.

It is another object of the present invention to provide a building block toy set of the above type wherein the basic units are provided with symmetrically arranged cavities on their edges which are adapted to receive disk like interconnecting elements.

Other objects of the present invention are to provide a building block toy set bearing the above objects in mind which is of simple construction, inexpensive to manufacture, has a minimum number of parts, is easy to assemble and entertaining to use.

DESCRIPTION OF THE PREFERRED EMBODIMENT

Figure 1:
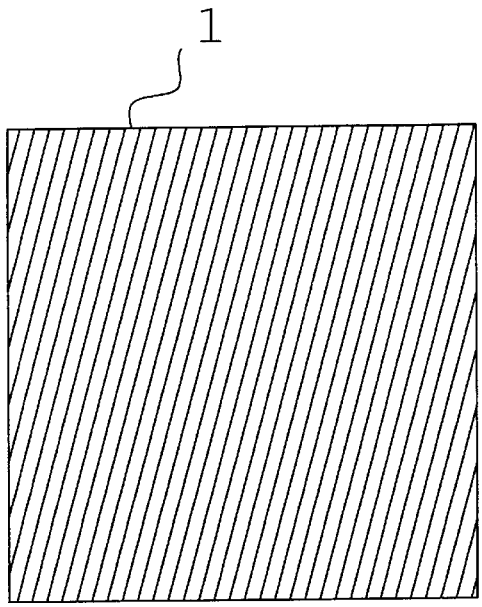
FIG. 1 is a top view of Flat Plate Surface Element 1.
Figure 2:
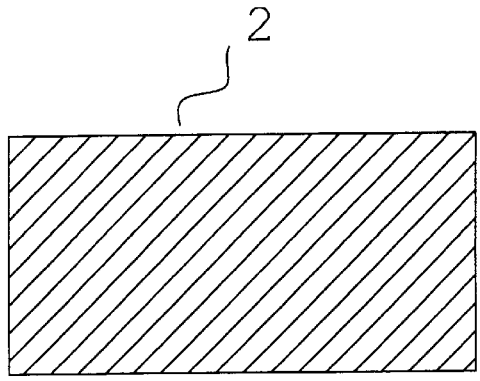
FIG. 2 is a top view of Flat Plate Surface Element 2.
Figure 3:
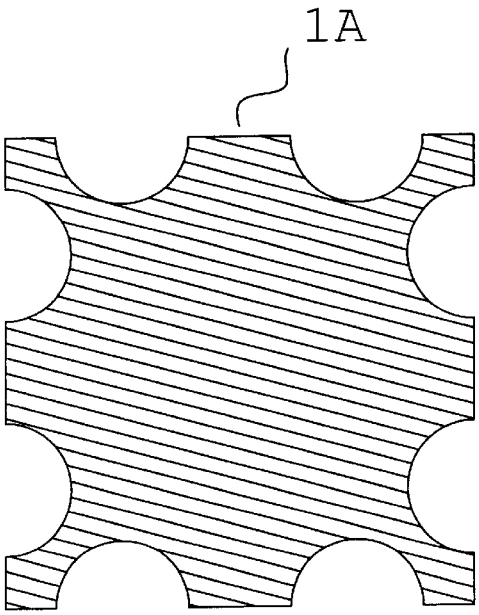
FIG. 3 is a top view of Flat Plate Interior Element 1A.
Figure 4:
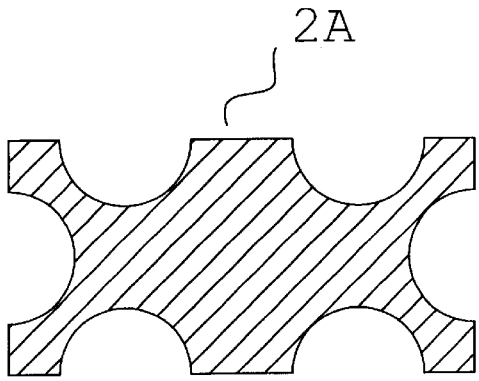
FIG. 4 is a top view of Flat Plate Interior Element 2A.
Figure 11:
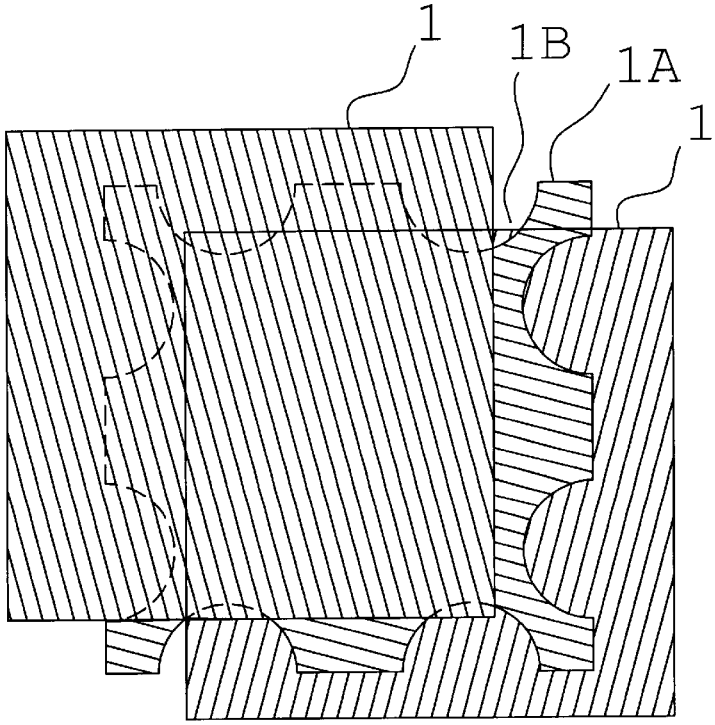
FIG. 11 is a top view of a Flat Plate Element offset for illustrative purposes.

FIG. 1 illustrates Flat Plate Surface Element 1. This element can be constructed of wood, plastic or other comparable materials. Each element is approximately one-quarter inch in thickness but may be thinner or thicker depending on the construction material and the desired surface strength required for a particular application. FIG. 11 shows a Flat Plate Element, offset for illustrative purposes, which is comprised of two Flat Plate Surface Elements 1 and a Flat Plate Interior Element 1A. The Flat Plate Interior Element 1A is the same length and width as Flat Plate Surface Element 1 with symmetrical semi-circular cutouts 1B around the periphery. The two Flat Plate Surface Elements 1 of the Flat Plate Element of FIG. 11 extend over semi-circular cutouts 1B to form a Flat Plate Element which contains cavities capable of receiving and securing therein the various configurations of interconnection elements as described below. The width of the of Interior Element 1A will be determined by the width of the interconnecting elements to be described herein. A Flat Plate Element is constructed by affixing a Flat Plate Surface Element 1 to the top and bottom of Interior Element 1A. to form a Flat Plate Element with cavities located along the periphery of the Flat Plate Element. The elements may be affixed together by gluing or other suitable methods known in the art. It is also possible to form a flat plate element with cavities by injection molding or similar processes known in the art. In the preferred embodiment the Flat Plate Elements measure 15.5 by 15.5 inches but it should be understood that alternative size elements are possible and encouraged. However, at least one side of each Flat Plate Element must have identically spaced cavities for another element to connect to it. A Flat Plate Element with only one side containing cavities may have the other three sides cut to represent various ornamental designs such as the top of a building or the like. Alternatively, the other three sides may only have a thin edge with a cutout to represent a window or the like. FIG. 2 illustrates a Flat Plate Surface Element 2 of a different width than Surface Element 1. FIG. 4 illustrates a Flat Plate Interior Element 2A with symmetrical Semi-Circular recesses. Due to a narrower width only one cutout is required on the short side. In the preferred embodiment Flat Plate Interior Element 2A measures 15.5 inches long by 7 inches wide. It should be understood that multi-dimensioned Flat Plate elements may be created to form different building block elements. It should be further understood that the number of Flat Plate Interior Element 1A recesses can be less or more depending on the desired structural stability of the interconnected Flat Plate Elements. Furthermore, it should be understood that cavities of different geometry's (e.g. Square, rectangular, triangular etc) may be formed within the Flat Plate Elements as long as corresponding mateable connecting elements are utilized.

Figure 5:
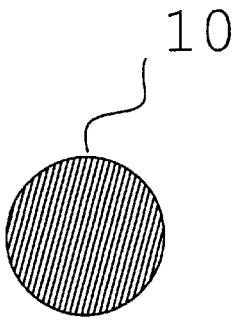
FIG. 5 is a top view of Circular Disk Element.
Figure 6:
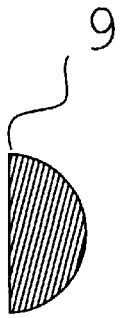
FIG. 6 is a top view of Semi-Circular Disk Element.
Figure 7:
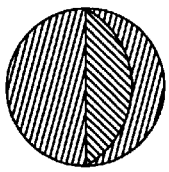
FIG. 7 is a side view of symmetrical 90-degree Disk Element.
Figure 8:
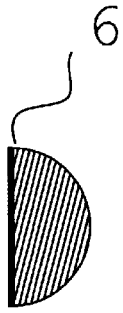
FIG. 8 is a side view of 90 degree Semi-Circular Disk Wedge 6.
Figure 9:
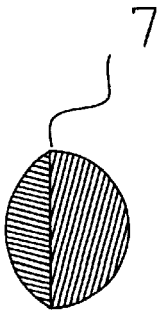
FIG. 9 is a side view of 45 degree Semi-Circular Disk Wedge 7.
Figure 10:
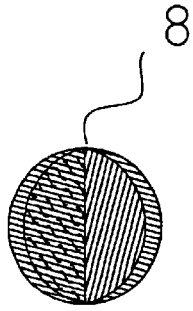
FIG. 10 is a side view of Dual Symmetrical 90-degree Disk Element 8.
Figure 12:
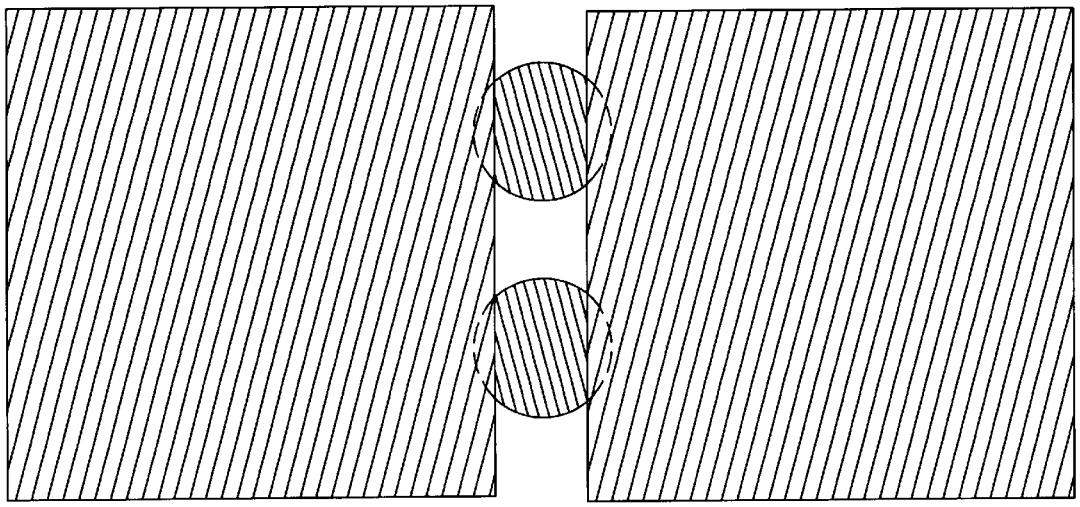
FIG. 12 is a top view of two circular disk elements connecting two flat plate elements.
Figure 13:
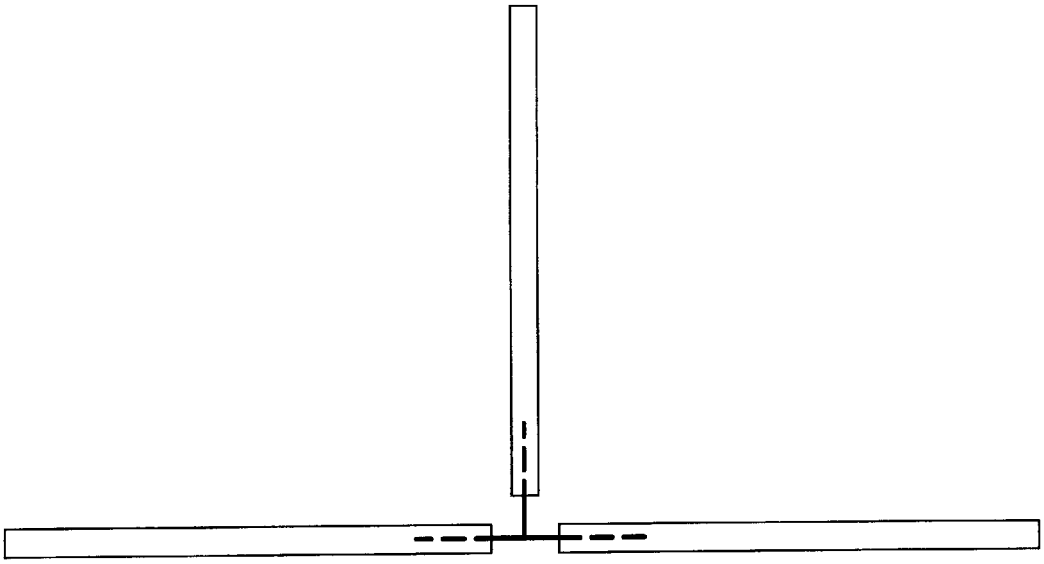
FIG. 13 is a side view of a symmetrical ninety degree disk element connecting three flat plate elements at ninety degree angles.
Figure 14:
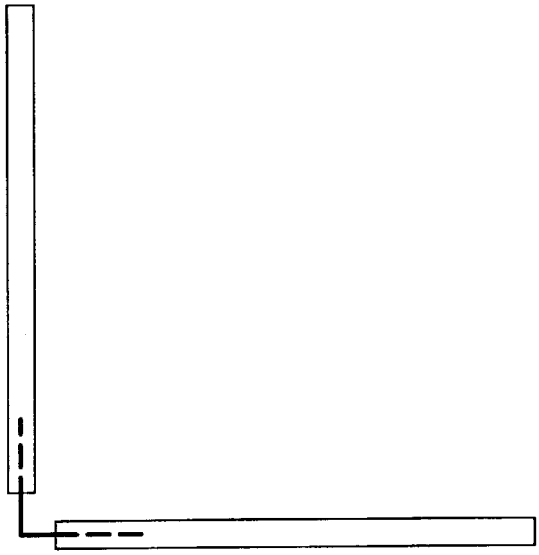
FIG. 14 is a side view of a ninety degree semicircular disk wedge interconnecting two flat plate elements at ninety degrees.
Figure 15:
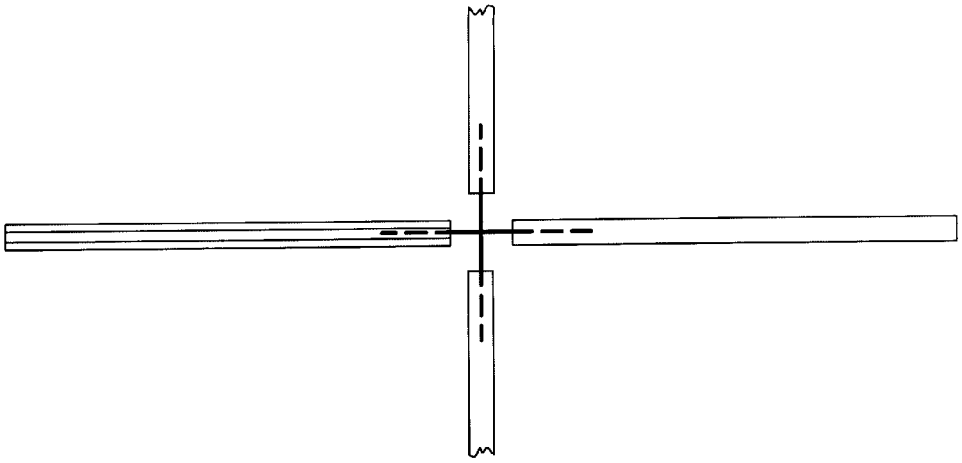
FIG. 15 is a dual symmetrical ninety degree disk element connecting four flat plate elements at ninety degree angles.
Figure 16:
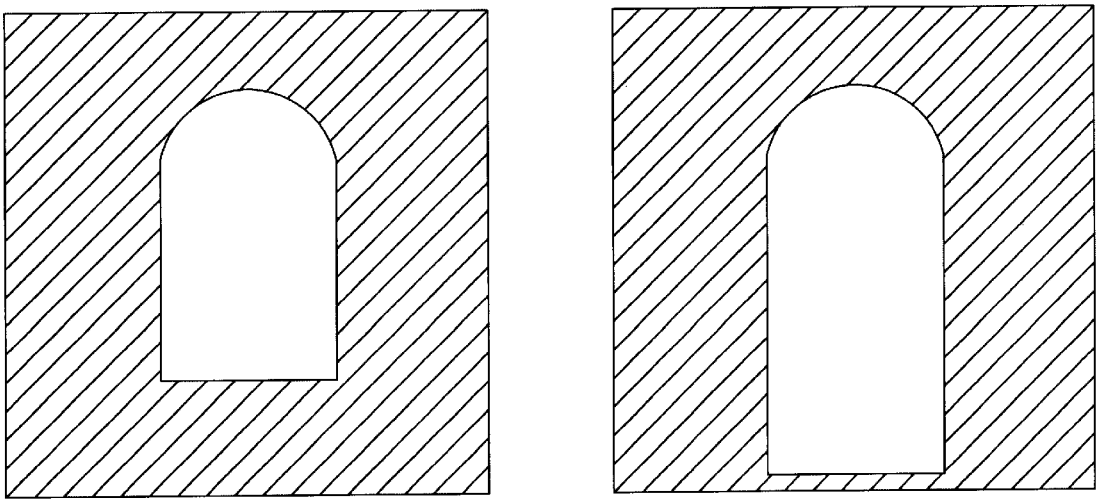
FIG. 16 is a flat plate element with a cutout to represent a window.
Figure 17:
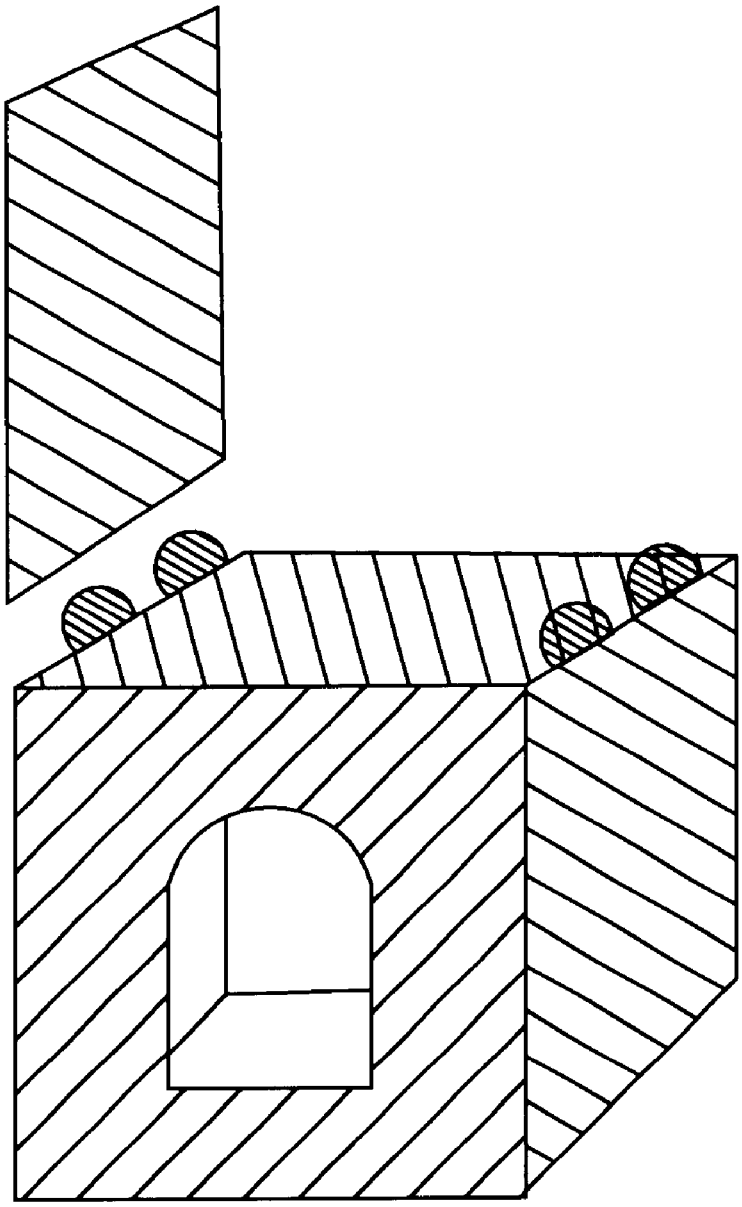
FIG. 17 illustrates the connection of flat plate elements to form structures.

The Flat Plate Elements are interconnected by a variety of interconnection elements. The Interconnection Elements may be manufactured from the same material used to make the Flat Plate Elements. In the Preferred embodiment, the dimensions of the interconnection elements are such to allow the semi-circular portions thereof to fit within the cavities of the flat plate elements. The fit should be secure enough to allow for minimal movement of the interconnection elements when inserted within the cavities of the Flat Plate Elements. FIG. 5 illustrates a top view of a Circular Disk Element 10 used to connect Flat Plate Elements in a zero degree horizontal configuration as illustrated in FIG. 12. FIG. 6 illustrates a side view of a Semi-Circular Disk Element 9 which is used in the construction of other interconnection elements. FIG. 7 is a side view of a Symmetrical Ninety-Degree Disk Element formed by the flat edge of a semi-circular disk element 9 bisecting one side of a circular disk element 10. This disk allows three Flat Plate Elements to be interconnected at ninety-degree angles as illustrated in FIG. 13. FIG. 8 illustrates two semi-circular disk elements 9 joined at their flat edge to form a Ninety Degree Semi-Circular Disk Wedge 11. This disk allows two flat plate elements to be interconnected at ninety-degree angles as illustrated in FIG. 14. FIG. 9 illustrates two semi-circular disks joined at their flat edge to form a Forty-Five Degree Semi-Circular Disk Wedge. FIG. 10 illustrates a circular disk with the flat edge of two semi-circular disks bisecting both sides of the circular disk to form a Dual Symmetrical Ninety-Degree Disk Element. This disk allows four Flat Plate Elements to be interconnected at ninety-degree angles to one another as illustrated in FIG. 15. The Flat Plate Elements may be prepared in a variety of colors, and have cutouts/designs to represent windows etc. in order to emphasize a particular part of a structure (e.g. Toy building), as well as to add visual appeal as illustrated in FIG. 16. These Flat Plate Elements are combined in the aforementioned manner to provide a variety of structures, with one such structure illustrated in FIG. 17. It will be readily apparent to those skilled in the art that various other geometrical configurations of Flat Plate Elements may be employed without departing from the spirit and scope of the invention. Furthermore, it will also be readily apparent that other configurations of circular/semi-circular disk elements, defining different interconnection angles, as well as defining different numbers of plate elements that can be connected to a disk, may be employed without departing from the spirit and scope of the invention.

I claim:

1. A building block toy set comprising a plurality of Flat Plate Elements, said Flat Plate Elements having a Top Surface Element, a Bottom Surface Element, and an Interior Element formed integrally therewith, said Interior Element having recesses located along the periphery of said Interior Element, said top surface element and said bottom surface element extending over said recesses to form cavities therein, Means for Interconnecting said Flat Plate Elements, said Interconnecting Means being of sufficient thickness and dimension to be received by said cavities of said Flat Plate Elements, said Interconnecting Means permitting the mating engagement of said plurality of said Flat Plate Elements to create a variety of structures.

2. A building block toy set as in claim 1 wherein said cavities are semi-circular.

3. A building block toy set as in claim 1 wherein said cavities are square.

4. A building block toy set as in claim 1 wherein said Top Surface Element, said Bottom Surface Element, and said Interior Element are the same length and width.

5. A building block toy set as in claim 1 wherein said Flat Plate Elements are 15.5 inches wide by 15.5 inches long.

6. A building block toy set as in claim 1 wherein said Plurality of Flat Plate Elements have identically spaced cavities.

7. A building block toy set as in claim 1 wherein said Plurality of Flat Plate Elements are made of wood.

8. A building block toy set as in claim 1 wherein said Plurality of Flat Plate Elements are made of plastic.

9. A building block toy set as in claim 1 wherein said thickness and dimension of said interconnection Means allows for minimal movement of said Interconnection Means within said cavities of said Flat Plate Elements, said interconnecting means being secured within said cavities by said top surface and said bottom surface of said flat plate elements.

10. A building block toy set as in claim 4 wherein said thickness and dimension of said Interconnection Means allows for minimal movement of said Interconnection Means within said cavities of said Flat Plate Elements, said interconnecting means being secured within said cavities by said top surface and said bottom surface of said flat plate elements.

11. A building block toy set as in claim 1 wherein said cavities are triangular.

12. A building block toy set as in claim 1 wherein said cavities are rectangular.

* * * * *

UNITED STATES PATENT AND TRADEMARK OFFICE

CERTIFICATE OF CORRECTION

PATENT NO. : 6,443,798 B1
DATED : September 3, 2002
INVENTOR(S) : Mike Perry

It is certified that error appears in the above-identified patent and that said Letters Patent is hereby corrected as shown below:

Column 4,
Line 18, after "...Plate Elements" delete "having" and insert -- including --.
Lines 20-21, after "...Interior Elements having" insert -- a plurality of --.
Lines 21-22, after "...Interior Elements," delete "said top surface element and said bottom surface element extending over said recesses to form cavities therein" and insert -- said Flat Plate Element further including a plurality of cavities, said cavities defined by said Top Surface Element and said Bottom Surface Element extending over said recesses --.
Line 25, after "...Elements," insert -- said interconnecting means being selected from the group consisting of a Circular Disk Element, a Semi-Circular Disk Element, A Symmetrical 90-degree Disk Element, a 90-degree Semi-Circular Disk Wedge, a 45-degree Semi-Circular Disk Wedge, and a Dual Symmetrical 90-degree Disk Element, --.
Lines 31, 33, 61 and 63, after "...wherein said" delete "cavities" and insert -- recesses --.
Lines 35-37, delete Claim 4.
Lines 47-53, delete Claim 9.
Lines 40-41, after "...wherein said" delete "Plurality of Flat Plate Elements have identically spaced".
Line 42, after "...cavities" insert -- are identically spaced --.
Line 54, delete "4" and insert -- 1 --.

Signed and Sealed this

First Day of July, 2003

JAMES E. ROGAN
*Director of the United States Patent and Trademark Office*